United States Patent [19]

Eichmanns et al.

[11] Patent Number: 4,505,713

[45] Date of Patent: Mar. 19, 1985

[54] METHOD AND APPARATUS FOR APPLYING PATTERNS TO A PLANAR STRUCTURE FROM DYE PATCHES FLOATED DOWN RAMP ON FILM OF CARRIER FLUID

[75] Inventors: Herbert Eichmanns; Wilhelm Meyer, both of Krefeld; Winfried Kemper, Wegberg, all of Fed. Rep. of Germany

[73] Assignee: Eduard Küsters Maschinenfabrik, Krefeld, Fed. Rep. of Germany

[21] Appl. No.: 471,000

[22] Filed: Mar. 1, 1983

Related U.S. Application Data

[62] Division of Ser. No. 120,470, Feb. 11, 1980, Pat. No. 4,375,158.

[30] Foreign Application Priority Data

Feb. 16, 1979 [DE] Fed. Rep. of Germany ..... 2905945

[51] Int. Cl.[3] ..... D06B 1/04; B05C 9/02; B05D 1/30

[52] U.S. Cl. ..... 8/483; 8/486; 8/501; 8/506; 68/205 R

[58] Field of Search ..... 8/483, 501, 486, 506

[56] References Cited

U.S. PATENT DOCUMENTS

| | | | |
|---|---|---|---|
| 1,846,845 | 2/1932 | Clark | 8/486 |
| 2,537,290 | 1/1951 | Williams et al. | 8/151 |
| 3,848,039 | 11/1974 | Schneppenhorst et al. | 264/73 |
| 3,992,142 | 11/1976 | Farre | 8/149 |
| 4,127,014 | 11/1978 | Miller et al. | 68/205 R |

FOREIGN PATENT DOCUMENTS 1578039 10/1980 United Kingdom .

*Primary Examiner*—A. Lionel Clingman
*Attorney, Agent, or Firm*—Kenyon & Kenyon

[57] ABSTRACT

A pattern is applied to a travelling web, such as a rug, by delivering a carrier liquid with individually spaced apart quantities of a pattern liquid therein to the surface of the rug. The pattern liquid is delivered into or onto the carrier liquid via various types of applicator means and the individual quantities of pattern liquid are maintained in spaced apart relation at least until being deposited onto the nap of the rug.

25 Claims, 11 Drawing Figures

METHOD AND APPARATUS FOR APPLYING PATTERNS TO A PLANAR STRUCTURE FROM DYE PATCHES FLOATED DOWN RAMP ON FILM OF CARRIER FLUID

This application is a division of application Ser. No. 120,470 filed Feb. 11, 1980, now U.S. Pat. No. 4,375,158.

This invention relates to a method and apparatus for applying patterns to a planar structure. More particularly, this invention relates to a method and apparatus for applying patterns to a travelling web of material.

Heretofore, various techniques have been known for applying patterns to planar structures, such as travelling webs of material for example textile webs and particularly rugs. Generally, two kinds of techniques have been used. Namely, in one technique, a pattern medium is transferred via a mechanical engagement with the web of material. In the other technique, a pattern creating medium is poured, sprayed or piled—one without other engagement with the web of material.

The mechanical engagement technique generally consists in passing the web of material through a roll gap while transferring a given pattern onto the web during passage through the roll gap, as is the case with any printing process. Alternatively, an irregular aperiodic pattern can be transferred onto the web in an irregular mixture, as in the methods according to German Pat. Nos. 357 990 and 401 307 wherein dyes are dropped or run onto transfer cylinders or elements cooperating therewith and taken along onto the roll gap.

In many cases, however, such a mechanical engagement with the web is not desirable either because the pattern is influenced in some way by the passage of the web through the roll gap, or because the web material may not withstand such engagement very well, such as is the case with nap material or pile carpeting.

The other technique for applying a pattern operates without a mechanical engagement with the web. For instance, one method for dyeing rugs is known, from DE-GM No. 19 71 517, in which a pattern-creating liquid is applied to or poured on the nap side of a rug by means of an applicator device in the form of a film or a mist. In this case, the applicator device employs a trough of dyeing liquid which extends across the width of the web of material and a cylinder which extends transversely to the web and is immersed in the trough at the lower part to take along dyeing liquid from the trough on its surface during rotation. The dyeing liquid is then wiped off the surface of the cylinder on the descending side during rotation by a wiper which is inclined downwardly at an angle toward the web and runs down the wiper to drop from the lower edge of the wiper to the web of material. This known method is intended for one-color dyeing, although several liquid applications can be made one after the other wet-on-wet.

The pattern-determining media can also be applied without contact in patterns. Besides the methods for spraying-on, in part with stencils, and for pouring-on linewise, methods according to Swiss Pat. No. 461 415 and German Auslegeschrift No. 17 60 657 are also know. In Swiss Pat. No. 462,415, controlled movable nozzles which emit intermittent dye jets exactly limited in accordance with a definite program, are arranged above and parallel to a web of carpeting with a nap and each individual dye pulse contains an exactly calculated amount of dye for penetrating the nap. In DE-AS No. 17 60 657, irregularly but closely spaced falling droplets are generated, which fall on a web-shaped textile material from above and impart to the latter a completely uncorrelated dot pattern and form a design which overall is uniform, but is "busy" close-up. One characteristic for these two methods is the relatively sharp delineation of the individual color dots.

The method according to DE-AS No. 17 60 657 has also been used so that the falling droplets are applied wet-on-wet onto a uniform coloring previously applied to the web of material. The droplets falling on the still moist preceding dye application react physically with the first dyeing liquid and, with suitable composition, execute a displacement effect which leads to a peculiar appearance of the pattern. Hence, the dropped-on dyeing liquid is thus, so to speak, left to itself and cooperates in a noninfluenceable manner with the first dyeing liquid and in this way, contributes, automatically to the formation of a pattern.

This effect is further pronounced in the method according to U.S. Pat. No. 3,848,039, in which a film of a solvent for a polymer material is generated on a carrier web and the polymer material is placed into this film in a random, irregular pattern. In this method, the polymer material becomes blurred on the film and is dissolved by the solvent at the edges, so that a peculiar pattern with running-out borders is obtained. The web with the pattern is then coated with a uniform polymer layer, upon which a web of textile material is subsequently applied. The carrier web is then removed. Thus, a so-called negative process is involved.

It is a common feature of all methods using droplets that the color dots that can be generated are relatively small since they stem from a droplet. While the individual pattern zones can be enlarged by the blurring, this requires the existence of a durable film of liquid on the web of material. This is normally not obtainable with webs of textile material and in particular, webs of carpeting.

Accordingly, it is an object of the invention to apply patterns which are not sharply delineated on planar structures without mechanical engagement.

It is another object of the invention to apply patterns on planar structures with pattern zones which are separated from each other at least in one direction and run out at the edges.

It is another object of the invention to apply patterns on planar structures with pattern zones which are larger than the color spots produced by the conventional drop methods.

Briefly, the invention provides a method and apparatus for applying patterns to a planar structure.

The method is comprised of the steps of adding a pattern liquid in individually spaced apart quantities to a carrier liquid and of transferring the carrier liquid with at least some of the individual quantities of pattern liquid onto a surface of a planar structure. The method is such that the pattern liquid is transferred to the web of material while floating in the carrier liquid. Thus, two liquids are not transferred to the web of material sequentially in order to give the second liquid, which makes the pattern, an opportunity to blend-in. Instead, the transfer of the carrier liquid and the individual quantities of pattern liquid contained therein is accomplished simultaneously in one and the same operation and by means of one and the same means. This not only reduces the equipment required but also, because the individual quantities of the pattern liquid are in the carrier liquid, improves the ability to handle the pattern liquid because the pattern liquid is given greater mobility. Finally, it reduces the feazing distribution which exists per se at the instant of the transfer. After the pattern liquid has settled on the web, the distribution is no longer influenced.

After being placed on or into the carrier liquid, the pattern liquid can float on the carrier liquid if the ratio of the specific gravities permits. However, it is also possible to have the individual quantities of the pattern liquid suspended in the carrier liquid or to have the pattern liquid sink only relatively slowly.

The planar structures can be any material on which a pattern is to be applied by means of a liquid patternapplication medium. While the development of the method was carried out with webs of carpeting with nap threads, other textile articles are also under consideration. The method is not limited to porous planar structures; for example, foil and the like can also be processed with the method.

The pattern liquid is preferably a dyeing liquid. However, other liquids may be used, for instance, liquids which influence the planar structure, for instance, as to feel, and the like.

A mixing of the pattern liquid and the carrier liquid must be delayed at least until the liquid is transferred to the planar structure, so that the pattern liquid is preserved in the form of individual quantities within the carrier liquid and pattern zones are established in which the pattern liquid is applied in different concentrations.

The pattern liquid may have a higher viscosity than the carrier liquid, to promote the cohesion of the individual quantities of the pattern liquid up to the transfer to the planar structure.

In principle, the pattern liquid and the carrier liquid may be soluble in each other or not. The former possibility is preferred, however, because dissolution and partial mixing of the pattern liquid and the carrier liquid in the adjacent areas then takes place in the phase between the penetration of individual quantities of the pattern liquid into the carrier liquid and the transfer to the planar structure or in a possibly necessary fixation step which promotes the flattening-out of the transitions.

In practice, the pattern applications will predominantly use a dye in an aqueous carrier liquid. To this end, the pattern liquid may be thickened relative to the carrier liquid to bring about a difference in the concentration between the pattern liquid and the carrier liquid. This is suitable for maintaining the individual quantities of the pattern liquid up to their transfer to the planar structure.

It is the main purpose of the carrier liquid to give mobility and transportability to the pattern liquid and to transport the pattern liquid onto the planar structure. In addition, however, it is possible to simultaneously utilize the carrier liquid for creating the patterns by incorporating a pattern-making medium into the carrier liquid to obtain a uniform pattern in the areas seized by the carrier liquid. In this manner, it is possible to obtain a pattern in a single-stage process in which the spots or dabs produced by the pattern liquid appear on a uniform pattern, i.e. generally a dyed background.

In a further embodiment, the individual quantities of the pattern may be, in turn, patterned in themselves. This can be realized practically by bringing a plurality of different pattern liquids together in a mixture and of thereafter dividing the mixture into individual quantities for addition to the carrier liquid. Thus, strands of different pattern liquids can, for instance, be brought together in one nozzle and given off intermittently or continuously.

One important embodiment of the method consists in having the pattern liquid contained in or on the carrier liquid added to the carrier liquid from the outside prior to the transfer of the carrier liquid to the web. In this manner, the distribution of the individual quantities of the pattern liquid in the carrier liquid, the mixing of these individual quantities and, optionally, their physical reaction with the carrier liquid in the form of mutual penetration in the border areas can be influenced.

The carrier liquid may also be agitated after adding of the pattern liquid. This may be carried out with a stirring and/or vibratory motion or by blowing a fluid medium into the carrier liquid.

In another embodiment, the method includes the step of generating a descending stream of the carrier liquid on an inclined run-off surface which extends toward and transversely of the planar structure. In this embodiment, the pattern liquid is added to the stream of carrier liquid at the lower end of the run-off surface. The stream or layer of the carrier liquid can be uniform or nonuniform and can be generated in any desired manner in the upper portion of the run-off surface. It has been found that this procedure has special advantages because no problems are encountered with the transport and the floating and wetting behavior of the pattern liquid. Rather, after the pattern liquid has struck the descending carrier liquid, the pattern liquid is taken along by the carrier liquid immediately and is transferred therein to the web.

In a further embodiment, the pattern liquid can be delivered to a second inclined run-off surface which extends transversely above the web of material and the first run-off surface and is transferred from the lower edge of the second run-off surface to the first run-off surface. According to this embodiment, the pattern liquid does not get directly into the carrier liquid which runs down on the first run-off surface, but is first influenced by the down-flow on the second run-off surface. The pattern is also influenced thereby. This is true particularly if a descending stream or layer of a carrier liquid is also generated on the second run-off surface, into which the pattern liquid is delivered.

Thus a kind of cascade effect is obtained which leads to a very random distribution of the pattern liquid in the carrier liquid, and which, if necessary, can be developed further by adding further run-off surfaces.

This is an important point, especially for the application of patterns on webs of carpeting. Such webs of carpeting are used quite preponderantly for covering rooms. In this connection, it happens frequently that different webs of carpeting or different sections of one web of carpeting meet. However, no difference of the pattern must be recognizable in the different zones. This is true particularly for superimposed structures which are reflected in the design and/or arrangement of the pattern areas, and in which certain features in the manufacture of the pattern are recognizable, such as longitudinal or crosswise stripes or diagonal structures. The pattern must be "freed of designs".

In order to further enhance this freedom of designs, it is advisable to make the descending layer, which is loaded with pattern liquid, additionally uneven on at least one of the run-off surfaces. This can be accomplishd by creating turbulance in the stream via a mechanical engagement with the layer or, preferably, by applying a carrier liquid which once more "confounds" the mixing of the flowing-down mixtures in order to suppress, for instance, longitudinal structures resulting from the downflow.

The introduction of turbulence also serves to remove designs if the carrier liquid is applied in individual jets, the position and direction of which are varied in a controlled manner and which may also be interrupted intermittently. The induced turbulence may also be introduced into a subsequently applied carrier liquid as well as to a carrier liquid flowing on two run-off surfaces. The application of the carrier liquid in individual jets avoids the formation of a uniform layer of the carrier liquid by forming a series of adjoining run-off zones, the edges of which meet and build up to form a larger layer thickness thereat. In this manner, the flow pattern is made considerably "more busy". This is also reflected in the greater randomness of the pattern, as is desired.

The pattern liquid can also be delivered into the carrier liquid in individual jets.

A special influence on the pattern is achieved if a carrier liquid containing a thickening is used.

If, for instance, the pattern liquid contains little or no thickening but the carrier liquid contains a thickening agent, the pattern liquid can still move soemwhat relative to the carrier liquid in the first moment after the application to the web of material. The pattern liquid then follows the surface relief provided by the thickened carrier liquid, so that patterns with finely branched pattern zones appear. A prerequisite for a uniform pattern, however, is that the web of material is quite horizontal. It may be advisable to deliver the pattern liquid to the thickened carrier liquid under a certain amount of pressure, for instance, from elevated supply tanks or under pneumatic pressure, so that the pattern liquid penetrates into the carrier liquid and remains right there.

Further removal of designs from the pattern while reducing the size of the pattern zones is obtained if the carrier liquid provided with the pattern liquid is scattered after leaving the lower edge of the first run-off surface. This can be accomplished, for instance, by a grid which is arranged underneath the run-off surface and is optionally moved.

The apparatus comprises a first means for transferring a stream of carrier liquid onto a surface of a planar structure and a dispensing means for adding a pattern liquid to the stream of carrier liquid in individually spaced apart quantities prior to transfer of the carrier liquid stream to the planar structure.

In one embodiment, the means for transferring the stream of carrier liquid includes a trough which extends transversely across a travelling web of the planar structure for receiving a supply of carrier liquid therein, a rotating cylinder and a wiper. The cylinder is mounted to have a lower surface disposed within the trough in order to receive a layer of the carrier liquid thereon while the wiper is disposed adjacent to the cylinder and at a downward inclination towards the travelling web in order to transfer a layer of carrier liquid on the cylinder onto the travelling web at a lower edge thereof. This construction is of particular advantage because the individual quantities of the pattern liquid can be introduced into the carrier in an easy manner from above. To this end, the dispensing means may add the pattern liquid into the trough, onto the cylinder, or onto the wiper.

Other embodiments of the apparatus are also possible wherein the liquid is transferred to the planar structure in a surge wave, a film, or a veil, i.e. in a substantially undivided quantity.

In another embodiment, the means for transferring the carrier liquid includes a pouring basin which extends transversely across a travelling web of the planar structure for receiving a supply of carrier liquid. In this case, the basin has an overflow edge for directing a stream of the carrier liquid onto the travelling web.

In another embodiment, the means for transferring the carrier liquid includes a tank which extends transversely across a travelling web of the planar structure for receiving a supply of carrier liquid. In this case, the tank has a slot nozzle in a lower end for directing a stream of the carrier liquid onto the travelling web. Further, the dispensing means is disposed above the tank in order to add the pattern liquid to the tank.

The above two embodiments are preferably intended for planar structures of web form which pass under the apparatus and onto which a surge wave, film or veil can be applied from above.

In still another embodiment, the means for transferring the carrier liquid includes an inclined run-off surface which extends transversely towards and across a travelling web of the planar structure and a plurality of nozzles for delivering the carrier liquid onto an upper portion of the run-off surface. In this embodiment, the liquid which is fed onto the run-off surface flows down the surface in a layer. However, because of the introduction via a plurality of nozzles, the liquid layer is uneven. This promotes the desired freedom from designs. The pattern may also be influenced by the type of nozzle, for instance, by a spray jet on the one hand and a more contained jet, on the other hand. Broad-jet nozzles arranged side by side can generate flows on the run-off surface which overlap at the edges and are twirled there.

A row of controlable valves extending transversely across the web of material may also be provided for dispensing the pattern liquid. The valves may be magnetic valves, for instance, or pneumatically operated valves which are capable of giving off dosed amounts of pattern liquid.

In another embodiment, a second inclined run-off extends transversely towards and across the first run-off surface and under the valves to receive individual quantities of pattern liquid from the valves for transfer to the first run-off surface.

The second run-off surface can be constructed as a coherent, substantially flat surface but can also include a plurality of upstanding ribs to sub-divide the surface into individual chute-like elements with pairs of the ribs approaching each other in a downward direction. Also, several valves of the pattern liquid can be associated with each chute-like element. In this manner, it is possible to dispense different pattern liquids into one each of the chute-like individual elements and to narrow them during the run-off in funnel-fashion. Thus, the mixture of the pattern liquids is transferred in a relatively narrow zone onto the first run-off surface and thereby into the web of material. In this manner, colored areas which are in themselves patterned can be generated on the web of material.

A feeding means may also be provided for delivering a layer of the carrier liquid onto the second run-off surface. In this case, the feeding means may include a plurality of nozzles for delivering the carrier liquid onto an upper portion of the second run-off surface.

Still further, a feeding device may be provided for delivering a carrier liquid onto a lower portion of the first run-off surface in order to introduce turbulence into the carrier liquid on the surface. This feeding means may also be formed of a plurality of nozzles.

In order to influence the pattern or to make the pattern more irregular, means are provided for moving at least some of the nozzles of the various transfer or feeding means or the run-off surfaces transversely of the run-off surface in a back and forth controlled manner. Also, a means may be provided for rotating at least some of the nozzles and/or the run-off surface about an axis disposed transversely of the run-off surface. This will permit the nozzles jets to impact against the run-off surfaces at different points. The relative motion of the rows of nozzles in the run-off surfaces in the transverse direction is essential for the pattern because components of the pattern liquid fall on top of each other and, thus, are able to interact with each other.

One embodiment of the first or lowermost run-off surface, which has been found to be very effective in tests, consists in having a transverse step near the lower edge to define a channel in the surface immediately upstream of the step. The flowing layer is held back in the step before being transferred to the web from the lower edge of the former so that a longitudinal structure of the pattern is further suppressed. This effect is further enhanced if a feeding device is aimed into the channel formed by the step and the layer of liquid temporarily collected there is additionally swirled together and mixed.

The same purpose is served if flow obstacles in the form of raised bumps, ribs or the like are provided on the run-off surfaces and optionally if a grid with parallel rods is arranged below the lower edge of the run-off surface as is known per se from DE-AS No. 1760657.

The angle of inclination of the run-off surfaces may be variable so as to allow a certain amount of adaption to different web velocities and/or viscosities of the liquids.

These and other objects and advantages of the invention will become more apparent from the following detailed description and appended claims taken in conjunction with the accompanying drawings in which:

Figure 1:
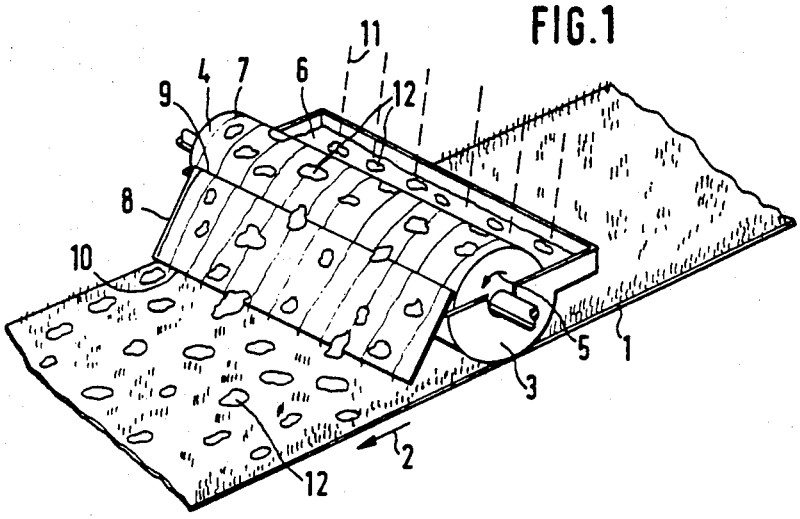
FIG. 1 illustrates a perspective view of the essential parts of a rug-dyeing machine according to the invention.

Referring to FIG. 1, the apparatus for applying a pattern to a planar structure such as a travelling web of velour carpeting which moves in the direction indicated by the arrow 2 employs a means for transferring a stream of carrier liquid onto the surface of the web 1 and a dispensing means for adding a pattern liquid to the stream of carrier liquid.

As shown, the means for transferring this stream of carrier liquid includes a trough 3 which extends transversely across the travelling web 1 for receiving a supply of carrier liquid 6 therein. In addition, this means includes a rotating cylinder 4 which extends across the trough 3 and has a lower surface disposed within the trough 3 to receive a layer of the carrier liquid 6 thereon. As indicated, the cylinder 4 rotates in the direction indicated by the arrow 5 so as to take along the carrier liquid 6 in a manner as indicated by the lines 7. The carrier liquid 6 is kept at the correct level in the trough 3 by suitable feeding devices (not shown). In addition, a wiper 8 is disposed adjacent to the cylinder 4 at a downward inclination towards the travelling web 1. The wiper 8 rests against the cylinder 4 and serves to wipe the carrier liquid 6 off the cylinder 4 at an upper edge 9. The carrier liquid then flows down the wiper 8 and is transferred from the lower edge 10 of the wiper 8 onto the web 1. As shown, the lower edge 10 of the wiper 8 is arranged close to the web 1.

Figure 2:
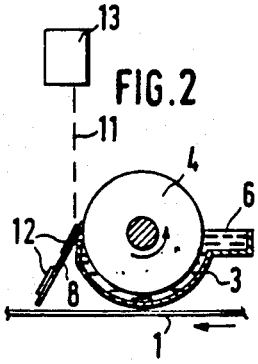
FIG. 2 illustrates a partial side view of the apparatus of FIG. 1 with a dispensing means for adding a pattern liquid to a wiper.

As shown in FIG. 2, the dispensing means 13 is disposed above the plane of the cylinder 4 so as to add a pattern liquid to the carrier liquid 6 in individually spaced apart quantities prior to transfer of the stream of carrier liquid 6 to the web 1. The individual quantities of the pattern liquid are shown by the dashed lines 11. These are individual droplets or sections of strands of a dyeing liquid provided with thickening. When the individual quantities 11 have dropped into the carrier liquid 6, they form cake-like quantites of dye 12 therein which float in the carrier liquid 6. Although these quantities 12 are basically soluble in the carrier liquid which consists of water, coherence of the cake-like individual quantities 12 in themselves is provided for a certain length of time due to a thickening thereof. As the cylinder 4 rotates, the individual quantities 12 are seized and transported over the top of the cylinder 4 and onto the web 1 in the overall bulk of the transferred carrier liquid 6. There, the cakes 12 form individual islands which remain lying on the tips of the nap of the web 1. The carrier liquid 6 disappears immediately in the pile. The cake-like individual quantities 12 of the thickened dyeing liquid are distributed over the web of carpeting only when the web 1 is run into a stream box, (not shown,) and is heated up, whereby the thickened dyeing liquid in the individual quantities 12 becomes less viscous and is imparted to the fibers. Thereupon, fixation and further processing take place in the usual manner.

Figure 3:
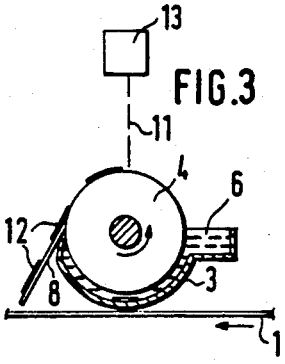
FIG. 3 illustrates a view similar to FIG. 2 of a dispensing means for dispensing a pattern liquid to a cylinder.
Figure 4:
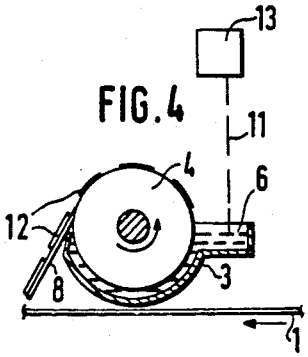
FIG. 4 illustrates a view similar to FIG. 2 of a dispensing means for dispensing a pattern liquid to the trough.

In FIG. 4, the individual quantities 11 may, alternatively, be delivered into the carrier liquid 6 in the trough 3 via the dispensing device 13. For this purpose, any known device for generating drops of liquid or other individual quantities of viscous media can serve. As shown in FIG. 2, the individual quantities 11 are delivered to the wiper 8, where the cakes 12 are floated away with the running-down carrier liquid 6 whereas, as shown in FIG. 3, the pattern liquid may be delivered to the cylinder 4, which takes them along immediately and transfers them in the form of cakes onto the wiper 8.

Figure 5:
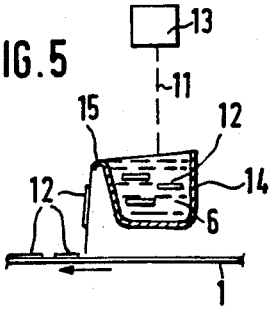
FIG. 5 illustrates a modified apparatus in accordance with the invention employing a pouring basin with an overflow edge.

Referring to FIG. 5, a pouring basin 14 can be provided instead of the wiper applicator of FIGS. 1 to 4, from which the liquid passes at an overflow edge 15 uniformly over the width of the web. The individual quantities of liquid 11 delivered from the dispensing device 13 form cakes 12, floating in the carrier liquid 6, of pattern liquid, which are taken along when the carrier liquid 6 flows over the overflow edge 15, and are transferred to the web 1.

Figure 6:
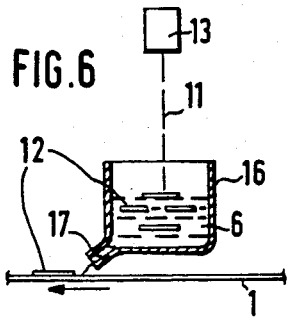
FIG. 6 illustrates a further embodiment of an apparatus according to the invention employing a tank with a slot nozzle.
Figure 7:
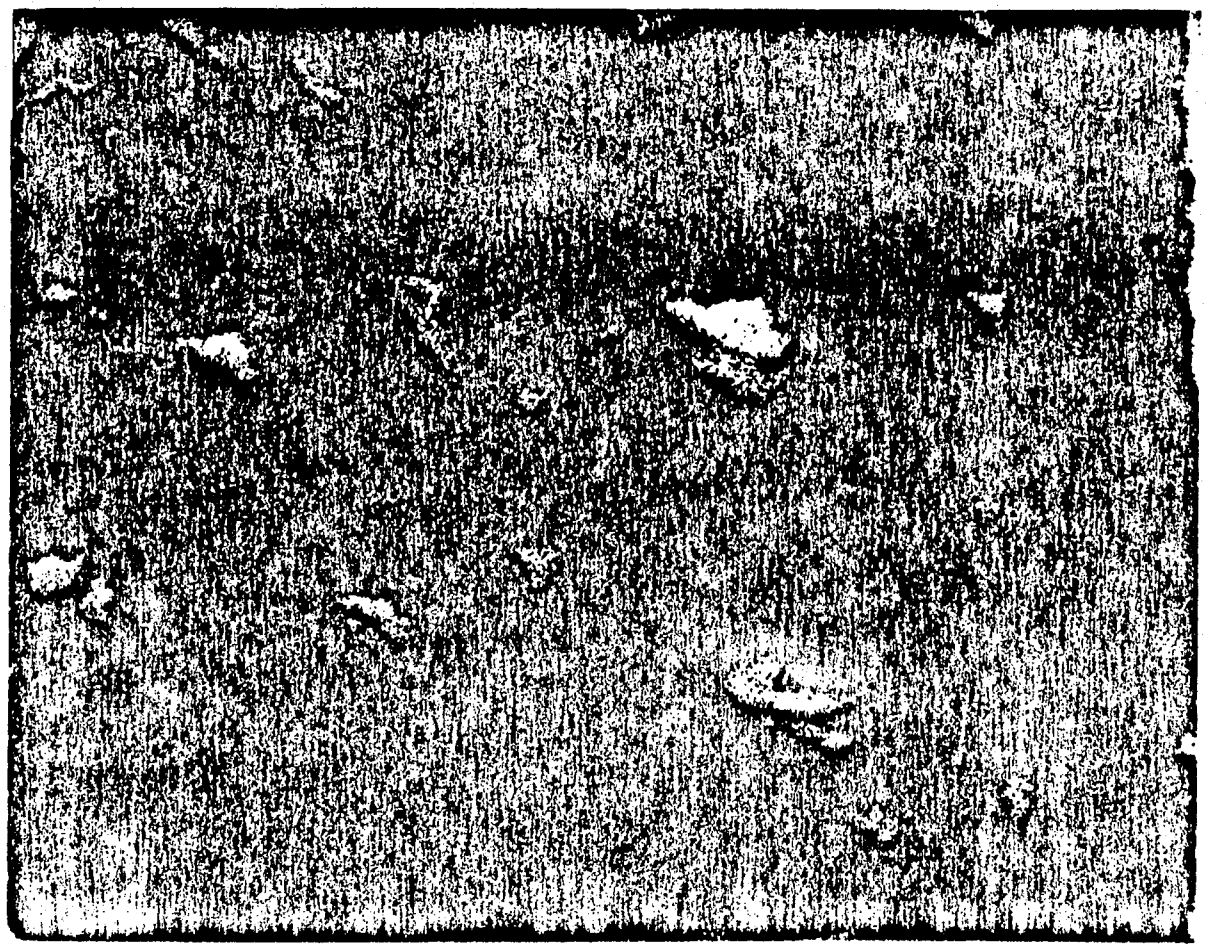
FIG. 7 illustrates an example of a pattern that can be produced in accordance with the invention.

Referring to FIG. 6, a liquid tank 16 may also be used which has a slot nozzle 17 in a lower end from which carrier liquid 6 is delivered to the web 1. In this delivery, the cakes 12 are taken along and transferred to the web 1. The slot nozzle 17 must naturally not be too narrow so that the cakes 12 of the pattern liquid are not held back or dissolved.

WORKING EXAMPLE 1

In apparatus according to FIGS. 1 to 4 and with carpeting of a velour material with an area weight of about 1000 g/m$^2$, padding (foularding) was carried out with a brown dyeing liquor which had the following composition:

| Composition of Foulard Liquor | |
|---|---|
| Indalka X C 15 | 10 grams |
| Hostapur C X | 2 |
| Isopropanol | 15 |
| Ammonium Sulfate | 5 |
| Telon Light Yellow RLN | 4.8 |
| Telon Light Red FRL | 3 |
| Telon Light Blue BRL 200% | 1.35 |
| Water | X (Remainder) |
| | 1000 grams |
| Viscosity | 1750 centipoise |

The web of material foularded (padded) in this manner was conducted, still wet, under an applicator means as per FIGS. 1 and 4. Into the amount of water contained in the trough 3, three dyeing liquids were dropped from three supply tanks with magnetic valves. These dyeing liquids had the following compositions:

| Composition of the Dye Applied | I | II | III Colorless |
|---|---|---|---|
| Indalka X C 15 | 8 g | 8 g | 8 g |
| Hostapur C X | — | — | — |
| Ammonium Sulfate | 5 | 5 | 5 |
| Isopropanol | 12 | 12 | 12 |
| Water | X | X | X |
| Telon Light Yellow RLN | 0.4 | 0.4 | — |
| Telon Light Red FRL | 0.22 | 0.13 | — |
| Telon Light Blue BRL 200% | 0.04 | 0.13 | — |
| | 1000 g | 1000 g | 1000 g |

Figure 10:
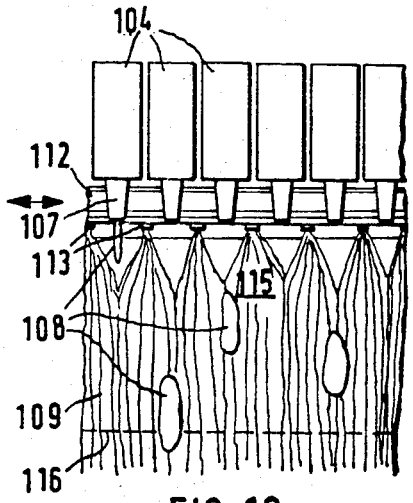
FIG. 10 illustrates a partial view taken on line II—II of FIG. 9.

The individual quantities of these dyeing liquids dropped into the water spread out in the trough 3 and on the cylinder 4 to form cakes 12 which were separated from each other in all three spatial dimensions and which were transported over a wiper 8 about 10 centimeters wide with a water film onto a web of carpeting 1. The water film sank through the porous web of carpeting 1, while the dyeing liquid cakes 12 were left lying on the web of carpeting 1 separately or partially on top of each other. After steaming, the dyeing liquid produced a marble-like pattern on the rug web 1 which was characterized by separate color zones with gently merging edge zones, as is seen in FIG. 10. The steaming was carried out in a drawer steamer with 100° saturated steam with sump for 5 minutes.

WORKING EXAMPLE 2

In an apparatus according to FIG. 5, a carrier liquid was used which contained kerosine and carbon tetrachloride in the ratio 2:1 and accordingly has a specific gravity of 1.080.

The pattern liquid had the following composition:

| | |
|---|---|
| 30 g | dye |
| 50 g | glycecine A |
| 300 g | urea/water 1/1 |
| 30 g | hexamethylene tetramine |
| 50 g | ammonium polyacrylate |
| 540 g | water |
| 1000 g | |

To this solution were added 2 cubic centimeters conc. Humectol C per 100 grams as a wetting agent.

As the dye in the composition given above, the following types were prepared:

| Substantive Dyes | Acid Dyes |
|---|---|
| Chloramine Brilliant Pink B | Fuller's Yellow H 5 G |
| Lurantin Light Turquoise Blue GLD | True Acid Purple |
| Sirius Black VE | Supranol True Red R |
| Benzo-Deep Black RW | Sulfanin Grey G |
| Solarflavin 6 G | Supranol Scarler GN |
| Solor Brown R | Silk Printing Black W |
| Sirius Light Yellow RT | Supramin Blue R |
| Choramine Scarlet GFL | Brilliant Acid Green 6 B |
| Benzo Blue 3 BS | Azocarmine BN |
| Solarflavin R | True Blue R |
| | Palatine True Pink BN |
| | Palatine True Black WAGN |
| | Supramin Blue FB |
| | Bengal Pink N |
| | Congo Orange G |
| | Superamin Yellow R |
| | True Acid Purple GBG |
| | Maneo Black for silk |
| | Solar Gray R |
| | Solar Brilliant Red BA conc. |
| | Sulfon Yellow RX |
| | Supramin Brown S |

Figure 8:
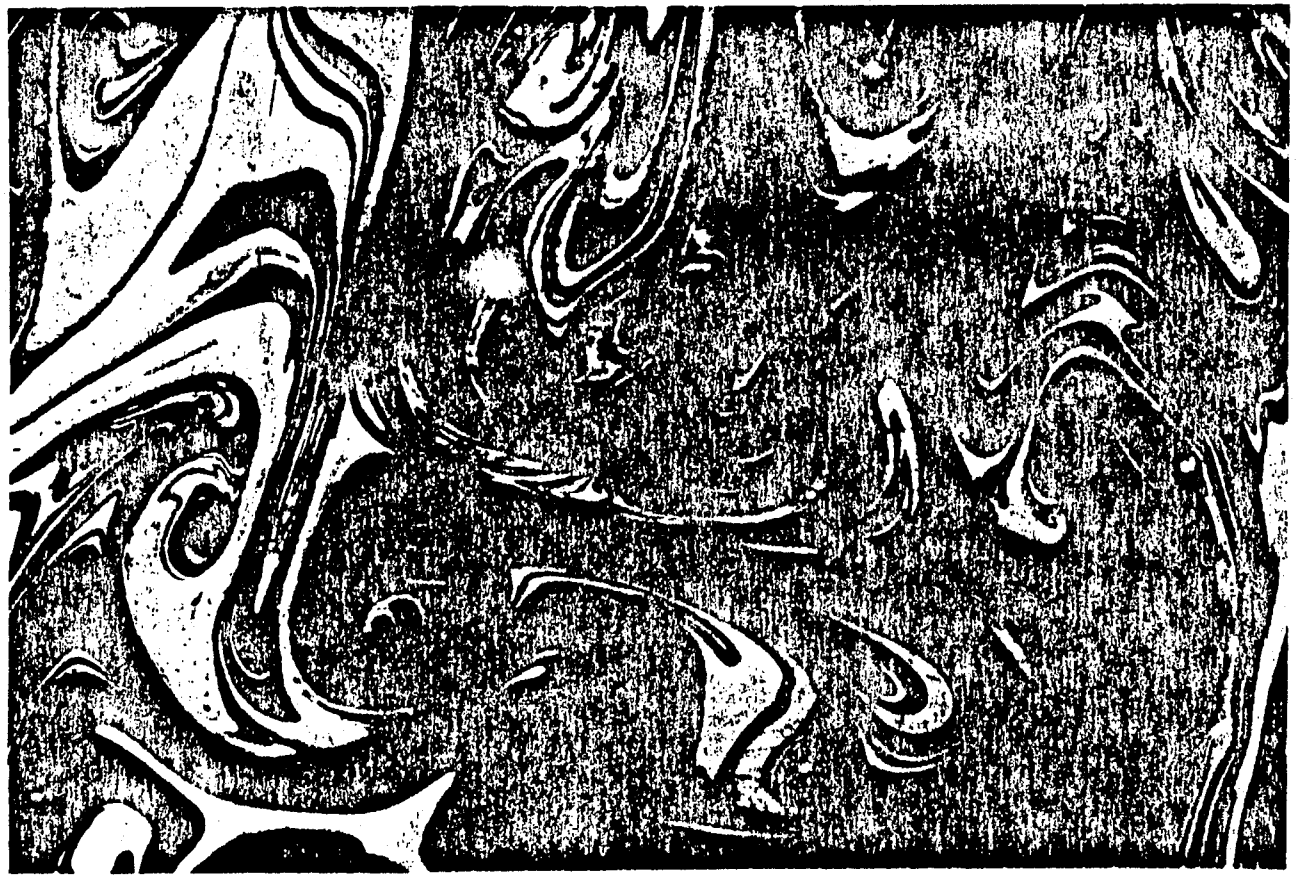
FIG. 8 shows a further example of a pattern which can be produced in accordance with the invention.

The pattern liquid prepared in this manner was dropped onto the carrier liquid. The pattern liquid was distributed in a coherent thin film over the entire surface of the carrier liquid. A Schlieren (Striae) pattern was obtained in which the individual striae form the separate individual quantities which correspond to the individual droplets. These were transformed, optionally aided by an appropriate attack on the film from the outside by blowing or stirring, into individual striae zones which remained coherent in themselves and were delineated relatively sharply against the adjacent striae zones. The film which already had a pre-formed pattern, was poured, floating on the carrier liquid and together with the latter, over the overflow edge 15 (FIG. 5) onto the web and was deposited on the web in the arrangement existing at the transfer. After the deposition on the web, no further engagement of the film took place. Patterns as in FIG. 8 developed on the web.

Figure 9:
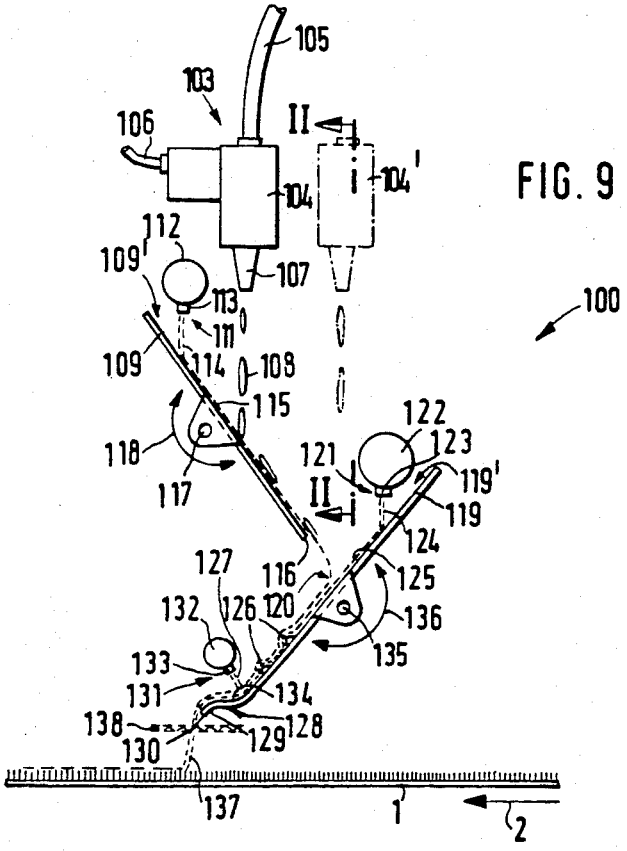
FIG. 9 illustrates a side view of a further modified apparatus according to the invention.

Referring to FIG. 9, wherein like reference characters indicate like parts as above, the apparatus 100 may also be constructed with a dispensing means in the form of a row of magnetic valves 104 located at a distance above the web of material 1 and which extends transversely to the web of material 1. The valves 104 are arranged adjacent to each other transversely to the web of material in the manner shown in FIGS. 10 and 11 and are supplied via flexible tubes 105 or the like with a pattern liquid in the form of a dyeing liquid for dyeing the web of material.

The magnetic valves 104 are operated via electric lines 106 and each delivers the pattern liquid in the form of jets or of droplets or jet sections generated by intermittent operation of the magnetic valve 104 via a discharge nozzle 107 in a downward direction.

The pattern liquid hits a run-off surface 109 of an applicator means which is formed as a substantially flat, elongated-rectangular plate and is arranged at a distance above the web of material 1 but below the valves 104 and extends transversely to the web of material. The surface 119 is inclined in the longitudinal plane perpendicular to the web 1, so that the pattern liquid 108 striking the run-off side 109' runs down over the run-off surface 109 to the right as viewed in FIG. 9.

The pattern liquid 108 can strike the run-off surface 109 directly. It is preferred, however, to provide a feeding means for the carrier liquid above the upper region of the run-off surface 109 which is formed by nozzles 113 which are arranged along a nozzle pipe 112 and are aimed toward the upper region of the run-off surface 109 to discharge jets 114 of the carrier liquid which is fed-in through the nozzle pipe 112. The nozzle pipe 112 is moved back and forth by a suitable device transversely to the web of material, i.e. perpendicularly to the plane of the drawing of FIG. 9. The individual jets 114 unite on the run-off surface 109 and form an irregular layer 115 which is moved on the run-off surface 109 because of the motion of the nozzle pipe 112 and into which the pattern liquid 108 drops and flows down together with the carrier liquid via the lower edge 116 of the run-off surface 109.

The run-off surface 109 is hingedly supported about a transverse axis 117, so that the position of the surface 109 can be varied in the direction indicated by the arrow 118 so as to influence the run-off velocity.

From the lower edge 116 of the run-off surface 109, the layer of carrier liquid 115 arrives with the pattern liquid 108, which is present in the carrier liquid in separated individual quantities, at a second run-off surface 119 of the applicator means. This latter surface 119 is arranged below the run-off surface 109. In addition, a feeding means 121 in the form of a row of nozzles 123 is located above the upper portion of the surface 109 above the point of impingement 120 of the liquid coming from the run-off surface 109. A nozzle pipe 122 delivers a carrier liquid 124 to the nozzles 123 for delivery to the run-off surface 119 in a manner similar to the nozzle pipe 112 and the run-off surface 109. The nozzle pipe 122 can also be moved back and forth perpendicularly to the plane of the drawing. An irregular layer 125 of the carrier liquid is formed again, into which the layer 115 of the carrier liquid with the pattern liquid 108 is delivered, whereupon all the liquids continue to flow together downward over the run-off surface 119. Protuberances in the form of bumps 126 are provided on the surface of the run-off plate 119 along the flow path in order to create turbulence in the descending stream of liquid.

A further feeding means 131 is provided in the vicinity of the lower edge of the run-off surface 119 which is formed by nozzles 133 which are distributed along a movable nozzle pipe 132 and from which a carrier liquid 128 is aimed at the layer of liquid flowing down over the lower portion of the run-off surface 119 in order to mix the stream once more and to make the stream more uneven before arriving at the web of material 1.

The lower edge of the run-off surface 119 has a step 128 which is bent toward the run-off side 119' and then extends again over a narrow edge region 129 in the original direction, so that the liquid can flow from the lower edge 130 of this edge region 129 onto the web of material. The step 128 forms a channel 134 immediately upstream into which the feeding means 131 is aimed so as to mix up the liquid which temporarily accumulates there.

The run-off surface 119 is also hingedly supported about a transverse axis 134 and can be inclined in the direction indicated by the arrow 136 depending on the requirements.

The different carrier liquids with the individual quantities of the pattern liquid 108 floating therein pass to the web of material 1 in a surge wave, veil or film 137. The places to which the pattern liquid are delivered are discretely separated from each other so that a pattern results. The web of material 1 is then processed further in the usual manner by steaming or another type of fixation.

The carrier liquids fed-in through the nozzle pipes 112, 122, 132 are, in general, identical and consist, for instance, of water, but they can also be different.

It is evident from FIG. 10 that the valves 104 are arranged transversely to the web in closely spaced relation. Of course, this is not mandatory. The pattern liquid 108 forms individual islands, cakes or zones which flow down over the run-off surface 109 with, in or on the layer 115 of the carrier liquid, and via the lower edge 116 of the run-off surface 109.

Figure 11:
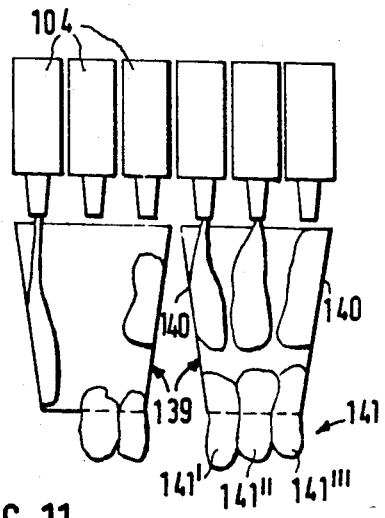
FIG. 11 illustrates a view similar to FIG. 10 of a further embodiment according to the invention.

According to FIG. 10, the run-off surface 109 is constructed as a plate which is coherent over the width of the web of material 1, as is the run-off surface 119. In FIG. 11, a modification is shown, in which the run-off surface is resolved into chute-like individual elements 139 which have on the sides, according to FIG. 11, ribs 140 which protrude perpendicularly from the plane of the drawing and approach each other in the downward direction, so that a funnel-like configuration is created. Three magnetic valves 104 each deliver their liquid to an individual element 139 so that individual quantities 141 of the pattern liquid which are composed of three optionally different components 141', 141'', 141''' slide down from the lower edge. In this manner, multi-colored color fields can be obtained on the web of material 1, which are spaced from each other because of the funnel-like construction of the chute-like individual elements 139.

As indicated by the dash-dotted rendering 104' in FIG. 9, it is also possible to dispense with the second run-off surface 109 and to deliver the pattern liquid directly to the first run-off surface 119 over which the carrier liquid from the nozzle pipe 122 flows.

The nozzle pipes 112, 122, 132 are rotatable about their longitudinal axis so as to adapt the angle and place of impingement. In addition, the nozzle jets can be interrupted intermittently or can be attenuated.

As shown in FIG. 9, a grid 138 may be located below the lower edge 130 of the run-off surface 119. The grid 138 can be moved back and forth or revolve in the transversal direction in order to scatter or disturb the falling surge wave, veil or film 137.

Any suitable means (not shown) may be used for moving at least some of the nozzles for the carrier liquid or pattern liquid transversely of the respective run-off surfaces 109, 119. Similarly, any suitable means (not shown) may be provided for rotating at least some of these nozzles and/or the run-off surfaces 109, 119 about an axis disposed transversely of the run-off surfaces 109, 119, respectively.

What is claimed is:

1. A method for applying patterns to a structure moving in a longitudinal direction which is maintained in a planar state during application of the patterns, said method comprising the steps of:

forming a layer of carrier liquid extending transversely to said longitudinal direction;

adding a pattern liquid in individually spaced apart quantities to said carrier liquid; and transferring said layer of carrier liquid with at least some of the individual quantities of pattern liquid simultaneously from above onto a surface of said moving structure.

2. A method as set forth in claim 1 wherein the pattern liquid has a higher viscosity than the carrier liquid.

3. A method as set forth in claim 1 wherein the pattern liquid is soluble in the carrier liquid.

4. A method as set forth in claim 3 wherein the pattern liquid is thickened relative to the carrier liquid.

5. A method as set forth in claim 1 which further comprises the step of incorporating a pattern-creating medium into the carrier liquid to obtain a uniform pattern.

6. A method as set forth in claim 1 wherein each of the individual quantities of pattern liquid is disposed in a patterned manner.

7. A method as set forth in claim 6 which further comprises the step of bringing a plurality of different pattern liquids together in a mixture and of thereafter dividing the mixture into said individual quantities for addition to the carrier liquid.

8. A method for applying patterns to a moving structure travelling in a longitudinal direction which is maintained in a planar state during application of the patterns comprising the steps of:

forming a layer of carrier liquid;

generating spaced apart quantities of pattern liquid extending transversely to said longitudinal direction; and simultaneously transferring said layer of carrier liquid and said pattern liquid from above onto a surface of said moving structure.

9. A method as set forth in claim 8 wherein the pattern liquid is added to the carrier liquid from above prior to said step of transfer to the planar structure.

10. A method as set forth in claim 9 which further comprises the step of agitating the carrier liquid after adding of the pattern liquid.

11. A method as set forth in claim 10 wherein a fluid medium is blown into the carrier liquid to agitate the carrier liquid.

12. A method as set forth in claim 1 wherein said step of transferring comprises the step of forming a descending layer of the carrier liquid on an inclined run-off surface extending toward and transversely of said longitudinal direction and allowing it to flow from the lower end of said run-off surface onto said moving structure, and wherein the pattern liquid is added to said layer at said lower end of the run-off surface.

13. A method as set for in claim 12 wherein said step of adding said pattern liquid comprises delivering the pattern liquid to a second inclined run-off surface extending toward and transversely of the first run-off surface, whereby the pattern liquid will flow from a lower edge of the second inclined run-off surface to the first inclined run-off surface.

14. A method as set forth in claim 13 which further comprises the step of forming a stream of the carrier liquid on the second run-off surface to receive the pattern liquid.

15. A method as set forth in claim 14 which further comprises the step of creating turbulence in the stream of carrier liquid on at least one of the run-off surfaces.

16. A method as set forth in claim 15 wherein the turbulence is mechanically produced.

17. A method as set forth in claim 15 wherein the turbulence is produced by application of a carrier liquid.

18. A method as set forth in claim 12 wherein the descending stream is generated from a plurality of jets.

19. A method as set forth in claim 18 which further comprises the step of controlling each jet relative to the position and direction thereof.

20. A method as set forth in claim 18 wherein each jet is intermittently operated.

21. A method as set forth in claim 12 wherein the pattern liquid is added from a plurality of jets.

22. A method as set forth in claim 12 which further comprises the step of scattering the pattern liquid after leaving the lower edge of the run-off surface.

23. A method as set forth in claim 1 wherein the carrier liquid contains a thickening agent.

24. A method for applying patterns to a web having a nap travelling in a longitudinal direction, said method comprising the steps of:

forming a layer of carrier liquid extending transversely to said longitudinal direction;

adding a pattern liquid individually spaced apart quantities to said carrier liquid, said pattern liquid quantities being separated from each other in at least two spatial dimensions;

transferring said layer of carrier liquid with at least some of the individual quantities of the pattern simultaneously from above onto a surface of said travelling web with the carrier liquid disappearing immediately into the nap and the individual quantities of pattern liquid remaining on the nap surface; and thereafter heating the web to distribute the pattern liquid into the nap of the web to fix the pattern liquid thereon.

25. A method as set forth in claim 24 wherein the pattern liquid is a dyeing liquid and the carrier liquid is water.

* * * * *